US005125145A

United States Patent [19]

Williams

[11] Patent Number: 5,125,145

[45] Date of Patent: Jun. 30, 1992

[54] TAMPING TOOL REMOVAL SYSTEM

[75] Inventor: Edward E. Williams, Clayton, Mo.

[73] Assignee: Ballast Tools Incorporated, Crystal City, Mo.

[21] Appl. No.: 649,660

[22] Filed: Feb. 25, 1991

[51] Int. Cl.[5] ..... E21B 19/00

[52] U.S. Cl. ..... 29/252

[58] Field of Search ..... 29/251, 252, 263, 255, 29/257; 254/29 R, 29 A, 30

[56] References Cited

U.S. PATENT DOCUMENTS

| | | | |
|---|---|---|---|
| 2,035,156 | 3/1936 | Hale | 254/30 |
| 2,967,044 | 1/1961 | Corcreham et al. | 254/30 |
| 3,494,592 | 2/1970 | Meschonat et al. | 29/252 |
| 3,638,294 | 2/1972 | Durant | 29/252 |
| 3,801,067 | 4/1974 | Shorter | 254/29 A |
| 4,189,817 | 2/1980 | Moebius | 29/252 |
| 4,646,411 | 3/1987 | Hankins | 29/252 |

*Primary Examiner*—Robert C. Watson

*Attorney, Agent, or Firm*—Rogers, Howell & Haferkamp

[57] ABSTRACT

A tamping tool removal system including a collar that houses a plurality of hydraulic fluid actuated pistons. The collar fits around the shank of the tamping tool with a channel groove in the collar receiving an annular ring on the shank. When hydraulic fluid extends the pistons against the retainer, the engagement between the ring and channel groove separates the tamping tool from the retainer. A retaining washer has a slot in its side for slidable mounting on a bolt without removal of the bolt from the shank. Tightening the bolt against the retaining washer presses the retaining washer against a surface of the tamping tool retainer to draw the shank tightly into a bore in the tamping tool retainer.

21 Claims, 1 Drawing Sheet

TAMPING TOOL REMOVAL SYSTEM

BACKGROUND OF THE INVENTION

This invention relates to a tamping tool removal system in conjunction with a tamping machine of the kind that is operated to tamp ballast along a railroad track. More particularly, the invention relates to a tamping tool removal system for removing one or more of the tamping tools from the tamping tool retainers that are carried by the tamping machine.

A conventional tamping machine has a plurality of tamping tool retainers that are oscillated upon operation of the machine. A tamping tool is connected to each tamping tool retainer by a connection that must allow removal of the tamping tool inasmuch as tamping tool bits require regular replacement from use. Since the installation of a tamping tool in its tamping tool retainer must be as firm as possible, a tamping tool retainer usually has a tapered bore for receiving a cooperating tapered shank section of the tamping tool. As the tapered shank section is drawn into the tapered bore by a tightening bolt, the fit becomes very tight. Furthermore, the tamping action during operation of the tamping machine tends to drive the tapered shank section even further into the tapered bore creating a strong compression fit and making subsequent removal of the tamping tool extremely difficult. Use of a sledge hammer, as is conventionally done, can take an hour or more and can produce flying chips hazardous to a person's eyes.

The tightening of the tapered shank portion into the tapered bore has conventionally been done by threading a bolt down against a retaining washer. The bolt is threaded into the top of the tamping tool shank and the retaining washer is pressed downwardly by the head of the bolt against a wall of the tamping tool retainer. That wall is defined by the bottom surface of a recess in the side of the tamping tool retainer that is provided to give a wrench access to the head of the bolt. Because the recess in the side of the retainer is necessarily small, operation of the wrench is confined by the side walls of the recess and only short rotational strokes of the wrench can be made. Consequently, in order to remove the bolt to allow removal of the retaining washer, many actuations of the wrench are necessary. Thus, removal of the conventional retaining washer has taken a considerable amount of time and effort.

SUMMARY OF THE INVENTION

This tamping tool removal system is for removing a tamping tool from a tamping tool retainer. The shank of the tamping tool is provided with a ring forming an annular collar below the tapered shank section of the tamping tool, locating the ring at a position spaced below the bottom of the tamping tool retainer. An expander collar of generally u-shape has an internal channel groove for receiving the ring when the expander collar is mounted on the tamping tool shank. The expander collar has a plurality of hydraulically actuated pistons that are normally retracted but that, when subjected to hydraulic pressure, will be driven upwardly against the bottom of the tamping tool retainer. Because of the engagement between the ring on the tamping tool shank and the channel groove in the collar, this upward movement of the pistons drives the expander collar and the tamping tool downwardly relative to the tamping tool retainer, freeing the tamping tool from the retainer. Biasing springs return the pistons to their normal retracted positions when the hydraulic pressure is released.

The retaining washer is provided with a slot through a side, creating a c-shape that allows the washer to be slid sideways onto the bolt. This avoids the necessity for removal of the bolt to install a retaining washer or alternatively to remove the retaining washer. A circular recess is provided in the upper surface of the retaining washer and a smaller conventional washer is received within the circular recess when the bolt is tightened. This conventional washer is of a diameter that is smaller than the diameter of the tapered bore so it need not be removed to remove the tamping tool. Yet, the smaller washer in the recess of the retaining washer prevents inadvertent lateral removal of the retaining washer in the event the bolt loosens from vibrations and impacts of the tamping tool retainer during operation of the tamping machine.

For some installations of tamping tools in tamping tool retainers, the axial stroke of the pistons may not be long enough to drive the tamping tool from the tamping tool retainer. For these installations, this tamping tool removal system includes a shim that is placed around the tapered shank portion of the tamping tool and is rested on top of the pistons. In use, the shim will be driven upwardly against the bottom of the tamping tool retainer when the hydraulic fluid pump is operated, thereby compensating for the insufficient lengths of the piston strokes.

DETAILED DESCRIPTION OF THE PREFERRED EMBODIMENT

Figures 1, 2, 3, 4, 5:
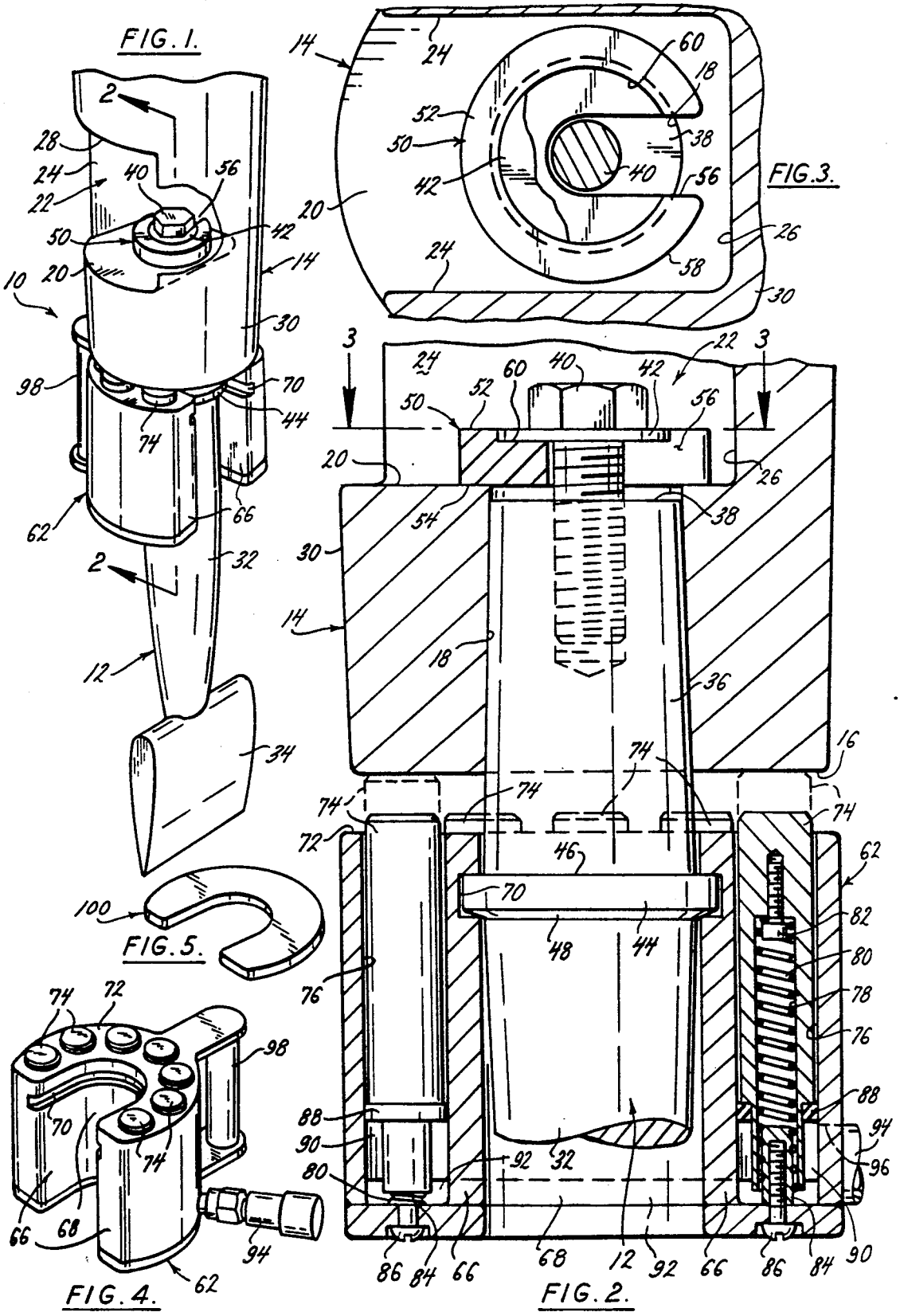
FIG. 1 is a perspective view of the tamping tool removal system showing the tamping tool removal expander collar positioned on a tamping tool that is installed on a tamping tool retainer.
FIG. 2 is an enlarged view in section taken along the plane of the line 2—2 of FIG. 1.
FIG. 3 is a view in section taken along the plane of the line 3—3 of FIG. 2.
FIG. 4 is a perspective view of the tamping tool expander collar.
FIG. 5 is a perspective view of a typical shim that may be used with this tamping tool removal system.

This tamping tool removal system 10 is for the removal of a tamping tool 12 from a tamping tool retainer 14. Typically, the tamping tool retainer 14 is one of many such retainers that depend from a tamping machine, and the tamping machine is the kind that is slowly driven along railroad tracks when track maintenance is required. The function of the tamping machine is to tamp ballast along the railroad tracks as is known in the art. Also, it is common for the tamping tool retainer 14 to have a lower surface 16 with a tapered bore 18 having its lower opening at a central area of the lower surface 16. The tapered bore 18 is of gradually reduced diameter as it extends upwardly, opening through a central area of a bottom wall 20 defined by a recess 22 in the retainer 14. In addition to the bottom wall, the recess 22 is defined by side walls 24, a back wall 26, and a sloping top wall 28. The recess 22 opens through the side wall 30 of the retainer 14 as shown in FIGS. 1 and 3.

The tamping tool 12 has a forged and machined shank 32 to which a tamping bit 34 is welded. As shown in FIG. 2, the upper shank section 36 is tapered with a gradually reducing diameter toward the upper end 38 of the shank so that the tapered section 36 of the shank 32, when introduced into the tapered bore 18 from the bottom 16, will be wedged or compressed firmly and tightly within the retainer 14.

The tamping tool 12 is supplied with a bolt 40 threaded into the upper section 36 of the shank 32, and there may be a washer 42 mounted on the bolt 40.

For this tamping tool removal system, the tamping tool shank 12 is forged with a ring 44 machined to form an annular flange around the shank 32, generally at the lower end of the tapered section 36. Since the ring 44 is of larger diameter than the shank 32, it can define a generally flat stop surface 46 on its upper side and a tapered surface 48 on its lower side. The function of the ring 44 will be described hereinafter.

This tamping tool removal system also preferably incorporates a special c-shaped retaining washer 50. The diameter of the retaining washer 50 is greater than the diameter of the tapered bore 18 in the tamping tool retainer 14. The retaining washer 50 has a top surface 52 and a bottom surface 54 and has a slot 56 opening through a side wall 58. The slot 56 allows the c-shaped retaining washer 50 to be slid onto the shank of the bolt 40 without requiring removal of the bolt as would be the case for a conventional washer that has a hole through its center.

Preferably, the c-shaped retaining washer 50 has a circular recess 60 in its upper surface 52 sized to receive the washer 42 when the bolt 40 is tightened. The diameter of the washer 42 is less than the diameter of the tapered bore 18. The recessed fit of the washer 42 within the recess 60 serves to retain the c-shaped retaining washer on the bolt 40 even if the bolt loosens from vibration during operation of the tamping machine.

The tamping tool removal system of this invention includes an expander collar that is generally u-shaped as shown in FIG. 4 with opposed generally parallel legs 66 extending from an arcuate rear wall 68. The space between the legs 66 is slightly greater than the diameter of the tamping tool shank 32. There is a continuous horizontal channel groove 70 formed within the inner side of the expander collar 62 as shown in FIG. 4.

The expander collar 62 has an upper surface 72 through which a plurality of pistons 74 project. Each piston 74 is slidable on a generally vertical axis within a cylinder 76 in the expander collar 62. The cylinders 76 orient the pistons 74 generally in a semi-circle that places them opposite the bottom wall 16 of the tamping tool retainer 14 when the expander collar 62 is installed on the tamping tool 12 as will be described.

As shown in FIG. 2, each piston has a recess 78 in it within which a tension spring 80 is positioned. The upper end of the tension spring is connected by a screw 82 to the piston 74. The lower end of the spring 80 is connected, such as by threading, to a sleeve 84 that is fastened by a screw 86 to the collar 62. The tension springs 80 normally retracts the pistons 74 downwardly into the cylinder 76 to the dotted line positions illustrated in FIG. 2.

A seal 88, such as a piston ring, is mounted on each piston 74 to provide a fluid seal between the lower chamber portion 90 of the cylinder 76 and the area of the cylinder above the seal 88. A fluid passage 92 extends between all the lower chamber portions 90 to provide fluid communication between them. A coupling 94 is connectable to the outer side of the collar 62, and the coupling has a passage 96 through it that communicates with one of the lower fluid chamber portions 90, as illustrated in FIG. 2. The coupling 94 is adapted to be connected by a conventional hose (not shown) to a conventional hydraulic fluid pump (not shown) to introduce pressurized hydraulic fluid to all the lower fluid chamber portions 90 that are in common communication by way of the fluid passage 92. Pumping of the hydraulic fluid applies pressure to the lower surfaces of the pistons 74 overcoming the tension of the springs 80 and driving the pistons 74 upwardly to and beyond the dotted line positions illustrated in FIG. 2.

The expander collar 62 is provided with a handle 98. Inasmuch as the collar is somewhat heavy, weighing in the neighborhood of twenty (20) pounds, it can be handled by manual grasping of the handle 98 with one hand and the coupling 94 with the other hand.

The tamping tool removal system may also include a shim 100 as illustrated in FIG. 5. The shim 100 is of u-shape similar to that of the collar 62 and therefore will fit around the shank 32 of the tamping tool 12. The function of the shim 100 will be described hereinafter.

Use

A conventional tamping tool is like the tamping tool 12 except it does not have the ring 44. A conventional retaining washer is like the washer 42 except it does not have the slot 56 but rather simply has a hole in its center. To install a conventional tamping tool in the retainer, the tapered section 36 of the shank is inserted into the tapered bore 18 until it wedges in place. Then the bolt 40 must be removed so that the conventional retaining washer (which has only a hole through its center) can be mounted on the bolt after which the bolt is rethreaded into the upper end of the retaining tool. Tightening of the bolt tightens the tamping tool in place in the retainer.

To remove this conventional tamping tool, the bolt must be not only loosened but completely removed so that the conventional retaining washer can be removed. Then, conventionally, the cutting tool must be beaten loose from the retainer. Because the space provided by the recess 22 is small, this is a difficult job and often requires as long as an hour or two of beating with a heavy sledge hammer.

For the present invention, the tamping tool is forged and machined with the ring 44 integral with the shank 32. The tamping tool is preferably supplied with the bolt and small washer 42 installed in the upper end of the shank section 36.

To mount the tamping tool 12 of the present invention in a retainer 14, the upper tapered section 36 of the shank can be inserted into the tapered bore 18 with the bolt 40 and washer 42 left on the tamping tool 12. When the tamping tool has been manually wedged into position within the tapered bore 18, the bolt 40 need only be loosened enough to slide the c-shaped retaining washer 50 in place with the bolt 40 received within the slot 56. Then, upon tightening the bolt 40, the washer 42 will be seated within the recess 60 and the tapered shank section 36 will be drawn tightly into the tapered bore 18.

To remove the tamping tool 12, the bolt 40 need not be removed but is merely loosened sufficiently to allow the washer 42 to be raised above the recess 60. This allows the retaining washer 50 to be slid free of the bolt 40. Next, the expander collar 62 can be mounted on the tamping tool shank 32 by sliding it into place as the annular ring 44 is received within the grooves 70. The flat upper side 46 of the ring 44 provides a firm bearing surface against the upper wall of the groove 70 whereas the tapered lowered side 48 of the ring 44 facilitates introduction of the ring 44 into the channel recess 70. Because of the shape of the expander collar 62 and the shape of a conventional tamping tool, the expander collar can be mounted from any angle radiating from the axis of the tamping tool.

Now, the hydraulic pump (not shown) which may be automatically or hand operated inasmuch as only moderate hydraulic pressure is required, is operated. Operation of the pump introduces hydraulic fluid under pressure through the coupling 94 into one of the lower chamber portions 90 of a cylinder 76. Because of the passage 92, the hydraulic fluid flows to all of the lower chamber portions 90 and hydraulic pressure on the pistons is automatically equalized. The hydraulic fluid pressure forces the pistons 74 upwardly as the ring 44 functions as a stop to prevent downward movement of the expander collar 62 relative to the tamping tool 12. The pistons 74 initially engage the bottom wall 16 of the tamping tool retainer 14. The individual pistons, under equalized pressure will allow contact even if the bottom wall 16 has an irregular surface. Further operation of the hydraulic fluid pump drives the pistons 74 further upwardly, forcing the expander collar 62 downward. The engagement between the channel groove 70 and the upper flat face 46 of the ring 44 drives the tamping tool 12 downward, breaking the compression fit between the tapered shank section 36 and the tapered bore 18 and allowing the tamping tool to fall downwardly and be removed from the retainer 14.

This removal process can then be repeated to remove all of the tamping tools 12 from all of the retainers 14 of a tamping machine.

There may be installations of tamping tools in retainers in which the rings 44 on the tamping tools 12 are spaced further below the bottom wall 16 of the retainers 14. For such installations, the shim 100 is used. The removal process is as just described except that, before beginning operation of the hydraulic pump, the shim 100 is inserted around the upper tapered shank section 36, resting on top of the pistons 74. Then, when the hydraulic pump is operated to drive the pistons 74 upwardly, they press the shim upwardly against the bottom surface 16 of the retainer 14 and the tamping tool is removed in the manner previously described. The shim 100 can be provided in one or more appropriate thicknesses to accommodate a variety of installations of tamping tools in tamping tool retainers.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A tamping tool removal system for removing a tamping tool from a pressed fit of a shank of the tamping tool within a bore in a tamping tool retainer comprising:

means defining a stop surface on the tamping tool;

means defining a stop surface on the retainer spaced from and opposite the tamping tool stop surface;

a pressure actuated expander having opposed bearing elements for positioning between the stop surfaces and movable relative to one another between contracted positions in which the bearing elements will fit between the stop surfaces and expanded positions in which the bearing elements are further apart than the space between the stop surfaces;

means for positioning the expander on the tamping tool with the bearing elements in contracted positions between the stop surfaces; and means for spreading the bearing elements to the expanded positions for forcibly driving the stop surfaces relatively away from one another thereby driving the tamping tool from the tamping tool retainer.

2. The tamping tool removal system of claim 1, including:

a bolt threaded into the upper end of the tamping tool;

a retaining washer of larger diameter than the diameter of the bore for installation under the head of the bolt and for bearing against a wall of the tamping tool retainer to lock the tamping tool to the tamping tool retainer when the bolt is tightened; and a slot in a side of the retaining washer for receiving the bolt and enabling installation and removal of the retaining washer without requiring removal of the bolt from the tamping tool.

3. The tamping tool removal system of claim 2 including;

a recess in the top of the retaining washer for receiving an element on the bolt to prevent inadvertent lateral removal of the retaining washer in the event the bolt loosens in use.

4. The tamping tool removal system of claim 3 wherein:

the element is a small washer mounted on the bolt and of smaller diameter than the diameter of the bore, and the recess is circular and of slightly larger diameter than that of the small washer.

5. The tamping tool removal system of claim 1 wherein:

the expander comprises a collar housing a plurality of cylinders;

a piston slidable within each cylinder on an axis parallel to the direction of spreading of the bearing elements;

means for normally biasing the pistons to retracted positions in the respective cylinders;

means for applying fluid pressure to the pistons for pushing them from the cylinders against the force of the biasing means and against one of the stop surfaces while the collar bears against the other stop surface.

6. The tamping tool removal system of claim 5 wherein:

the collar is generally u-shaped having legs for fitting on opposite sides of the tamping tool and having an arcuate wall between the legs and extending around a portion of the shank;

the legs and the end wall having a continuous substantially planer top surface;

means on the retainer defining said one surface and means on the tamping tool shank defining said other surface;

the pistons projecting through the top surface for bearing upwardly against said one surface; and means defining a wall on the collar for bearing downwardly against said other surface.

7. The tamping tool removal system of claim 5 wherein:

the means for applying fluid pressure comprises a hydraulic pump and the fluid is hydraulic fluid.

8. The tamping tool removal system of claim 6 including a shim positionable between the pistons and said one surface for reducing the distance of piston stroke required to separate the said surfaces.

9. The tamping tool removal system of claim 6 wherein:

said other surface is defined by a ring immovable on the tamping tool shank; and said means defining a wall on the collar comprises a channel groove on the inner side of the u-shaped collar for receiving the ring when the collar is mounted on the shank.

10. The tamping tool removal system of claim 9 wherein:

the upper surface of the ring and the lower surface of the channel groove are substantially horizontal and flat; and the lower surface of the ring is tapered to facilitate introduction of the ring into the channel groove.

11. A tamping tool removal system for removing a tamping tool from a tamping tool retainer comprising:

a collar, least one fluid chamber in the collar, a piston slidable in the fluid chamber and having a head exposed from a side of the collar, means to mount the collar to a shank on the tamping tool with the piston head positioned to bear against a ace of the tamping tool retainer, means interengaging between the tamping tool shank and the collar for preventing axial movement of the collar relative to the shank, and means for applying fluid pressure to the chamber to extend the piston and thereby for applying pressure against the face of the tool retainer to drive the tamping tool from the tool retainer.

12. The tamping tool removal system of claim 11 wherein:

there is a plurality of cylinders having generally vertical axes in a generally arcuate array and a plurality of pistons each axially slidable in a respective one of the cylinders;

the arcuate array of cylinder axes positioning the pistons below a face on the retainer laterally beyond a shank of the tamping tool.

13. A tamping tool removal system for removing a tamping tool from a tamping tool retainer comprising:

a tamping tool having a shank for insertion in a compression fit within a bore in the retainer;

an expandable member;

a ring immovable on the shank for engagement by the expandable member and for supporting and responding to pressure exerted by the expander against the retainer in one direction and the ring in the opposite direction to withdraw the shank from the bore;

the expandable member comprises a collar having a plurality of hydraulic cylinders with pistons slidable in them;

a plurality of springs for normally withdrawing the pistons into the cylinders; and means for applying hydraulic fluid pressure to drive the pistons outward from the cylinders against a wall of the retainer while the collar is positioned with the ring in the channel groove.

14. The tamping tool removal system of claim 13 including:

a retainer washer for bearing against a surface of the tamping tool retainer;

a bolt threaded in the shank for tightening a head on the bolt against the retainer washer; and a slot in a side of t he retainer washer for installation of the washer under the bolt head without requiring removal of the bolt from the shank.

15. The tamping tool of claim 13, wherein:

the stop means defines surface areas on a circumference about the shank.

16. The tamping tool of claim 15, wherein:

the stop means comprises a ring in a plane transverse to the axis of the shank.

17. A tamping tool and a retainer for a tamping tool removal system wherein the tamping tool has a shank received within a bore of the retainer and the retainer has a surface extending laterally of the bore, comprising:

a retaining washer of larger diameter than that of the bore;

a bolt having a bolt shank threaded into the top of the tamping tool shank;

a head on the bolt shank;

a slot in a side of the retaining washer for receiving the bolt shank;

the slot being wider than the bolt shank and narrower than the bolt head whereby to remove the tamping tool from the retainer, the retaining washer can be laterally withdrawn upon loosening the bolt and without requiring removal of the bolt from the tamping tool shank.

18. The tamping tool and retainer of claim 17 wherein the opposing stop surfaces on the retainer and on the tamping tool are for cooperating with the tamping tool removal system for driving the tamping tool shank from the bore upon expansion of the expander.

19. The tamping tool and retainer of claim 18 wherein the opposing stop surfaces are for a removal system having an expander which includes a plurality of hydraulically actuatable pistons.

20. A tamping tool removal system for removing a tamping tool from a retainer wherein the tamping tool has a shank received within a bore of the retainer and the retainer has a surface extending laterally of the bore, comprising:

a retaining washer of larger diameter than that of the bore;

a bolt having a bolt shank threaded into the top of the tamping tool shank;

a head on the bolt shank;

a slot in a side of the retaining washer for receiving the bolt shank;

the slot being wider than the bolt shank and narrower than the bolt head whereby to remove the tamping tool from the retainer, the retaining washer can be laterally withdrawn upon loosening the bolt and without requiring removal of the bolt from the tamping tool shank; and an expander expandable between opposing stop surfaces on the retainer and on the tamping tool for driving the tamping tool shank from the bore upon expansion of the expander.

21. The tamping tool removal system of claim 20 wherein:

the expander includes a plurality of hydraulically actuable pistons.

* * * * *

UNITED STATES PATENT AND TRADEMARK OFFICE

CERTIFICATE OF CORRECTION

PATENT NO. : 5,125,145

DATED : Jun. 30, 1992

INVENTOR(S) : Edward E. Williams

It is certified that error appears in the above-identified patent and that said Letters Patent is hereby corrected as shown below:

Column 4, line 41, "cutting tool" should be — tamping tool —.

Column 7, line 29 (claim 11), "ace" should be —face—.

Column 8, line 5 (claim 14), "t he" should be — the —.

Signed and Sealed this

Twelfth Day of October, 1993

Bruce Lehman

*Attest:*

BRUCE LEHMAN

*Attesting Officer*

*Commissioner of Patents and Trademarks*